US011271283B2

(12) United States Patent
Mityashin et al.

(10) Patent No.: US 11,271,283 B2
(45) Date of Patent: Mar. 8, 2022

(54) MONOLITHICALLY INTEGRATED ANTENNA DEVICES

(71) Applicant: IMEC VZW, Leuven (BE)

(72) Inventors: Alexander Mityashin, Heverlee (BE); Soeren Steudel, Oud-Heverlee (BE); Kris Myny, Heusden-Zolder (BE); Nikolaos Papadopoulos, Leuven (BE); Vlatko Milosevski, Eindhoven (NL); Paul Heremans, Leuven (BE)

(73) Assignee: IMEC vzw, Leuven (BE)

( * ) Notice: Subject to any disclaimer, the term of this patent is extended or adjusted under 35 U.S.C. 154(b) by 0 days.

(21) Appl. No.: 16/766,994

(22) PCT Filed: Dec. 21, 2018

(86) PCT No.: PCT/EP2018/086573

§ 371 (c)(1),
(2) Date: May 26, 2020

(87) PCT Pub. No.: WO2019/122326

PCT Pub. Date: Jun. 27, 2019

(65) Prior Publication Data

US 2020/0395652 A1 Dec. 17, 2020

(30) Foreign Application Priority Data

Dec. 21, 2017 (EP) ..... 17209346

(51) Int. Cl.
*H01Q 1/24* (2006.01)
*H01Q 1/22* (2006.01)
(Continued)

(52) U.S. Cl.
CPC ..... *H01Q 1/2283* (2013.01); *H01Q 1/2225* (2013.01); *H01Q 1/38* (2013.01); *H01Q 1/526* (2013.01); *H01Q 9/0414* (2013.01)

(58) Field of Classification Search
CPC ..... H01Q 1/2225; H01Q 1/2283; H01Q 1/38; H01Q 1/526; H01Q 9/0414
See application file for complete search history.

(56) References Cited

U.S. PATENT DOCUMENTS 7,709,309 B2 * 5/2010 Moriwaka ..... H01L 21/02686 438/166
7,772,523 B2 * 8/2010 Tanaka ..... H01L 21/02672 219/121.8
(Continued)

FOREIGN PATENT DOCUMENTS

EP 1988575 A2 11/2008
WO 2005088704 A1 9/2005

OTHER PUBLICATIONS

International Search Report and Written Opinion, PCT Application No. PCT/EP2018/086573, dated Mar. 20, 2019, 12 pages.

*Primary Examiner* — Thien M Le
(74) *Attorney, Agent, or Firm* — McDonnell Boehnen Hulbert & Berghoff LLP

(57) ABSTRACT

Example embodiments relate to monolithically integrated antenna devices. One embodiment includes a monolithically integrated antenna device that includes a substrate having a first surface and a second surface. The monolithically integrated antenna device also includes a transistor component layer that includes at least one electronic component therein. Further, the monolithically integrated antenna device includes at least one antenna structure formed on the substrate or the transistor component layer. The antenna structure is configured to operate in a frequency range of between 30 kHz and 2.4 GHz. The substrate is configured to have a size that is the same or larger than the at least one antenna structure. The at least one antenna structure is formed in a stack with the transistor component layer and the substrate. The monolithically integrated antenna device is configured
(Continued)

to shield the at least one electronic component in the transistor component layer from electromagnetic interference.

11 Claims, 11 Drawing Sheets

(51) Int. Cl.

| | |
|---|---|
| ***H01Q 1/38*** | (2006.01) |
| ***H01Q 1/52*** | (2006.01) |
| ***H01Q 9/04*** | (2006.01) |

(56) References Cited

U.S. PATENT DOCUMENTS

2005/0135181 A1* 6/2005 Shionoiri ..... G11C 16/08 365/230.06
2005/0168339 A1* 8/2005 Arai ..... G06K 19/07722 340/572.8
2007/0170505 A1* 7/2007 Tokunaga ..... H01L 27/1255 257/347
2008/0224831 A1* 9/2008 Arai ..... G06K 7/10178 340/10.51
2009/0255995 A1* 10/2009 Shionoiri ..... G06K 19/0715 235/492
2010/0025831 A1* 2/2010 Yamazaki ..... H01L 27/13 257/679
2010/0127084 A1 5/2010 Pavate et al.
2011/0134680 A1* 6/2011 Saito ..... G11C 17/12 365/104
2012/0087065 A1* 4/2012 Kim ..... G06F 1/1656 361/679.01

* cited by examiner

MONOLITHICALLY INTEGRATED ANTENNA DEVICES

CROSS-REFERENCE TO RELATED APPLICATIONS

The present application is a national stage entry of PCT/EP2018/086573 filed Dec. 21, 2018, which claims priority to EP 17209346.0 filed on Dec. 21, 2017, the contents of each of which are hereby incorporated by reference.

FIELD OF THE DISCLOSURE

The present disclosure relates to monolithically integrated antenna devices.

BACKGROUND OF THE DISCLOSURE

Thin film wireless identification tags may operate at frequencies below 1 GHz, for example, in radio frequency identity (RFID) tags, near-field communication (NFC), capacitive identification (CAPID). Such wireless ID tags typically comprise two sub-components, namely, the chip or integrated circuit and the antenna. The chip is responsible for the electronic functionality, such as: matching the antenna, rectifying the AC input wave to a DC supply, storing the tag memory, reading incoming signals from the reader, transmitting outgoing signals to the reader. The antenna is responsible for converting these signals into electromagnetic waves and sending them to the reader.

The chips and antennas are fabricated separately using different technologies, and, are assembled together in a tag assembly process. A typical delivery format for chips is a diced wafer on a temporary carrier as the size of the chip is small, usually below 1 $mm^2$. A typical delivery format for antennas is antenna components glued to a temporary carrier (typically a paper-based roll), and, the size of the antenna is large, usually above several $cm^2$. A pick-and-place assembly step is used to connect the chip and the antenna.

Pick-and-place assembly is a relatively complex process, and has several limitations:

Limited throughput: The throughput of the assembly process is reciprocal to the total time used to assemble one tag. The time, in turn, is defined by the sum of the sub-step times and may be up to several seconds. This is a limitation for manufacturers. Moreover, any delays or failures might cause process disruption and limit the throughput even further.

Limited yield: The yield depends on the throughput and implementation of the sub-steps. As a general rule of thumb—higher throughputs (faster process) result in lower process accuracy and consequently in lower yield. Non-working devices are discarded from manufacturing, or simply lost. Limited yield drives the tag cost up and this is a problem for manufacturers.

Testing and quality control: Any faulty tags may be removed from the final delivery. This may include intermediate testing and quality control. At least two different quality control steps are implemented for: (i) testing of individual chips and antennas before the assembly; and for (ii) testing of the complete tag after the assembly.

Finally, the assembly process includes advanced material and equipment, which entails additional manufacturing costs.

A semiconductor device in which an antenna is integrally formed with an integrated circuit as described in WO-A-2005/088704. The antenna is integrally formed with a transistor component layer on a substrate, electronic components in the transistor component layer being configured to be connected to the antenna element. Such a semiconductor device has improved mechanical strength but includes the provision of an insulating layer containing fine particles of a soft magnetic material over the antenna to reduce suppress the generation of eddy currents in conducting wires forming the antenna in order to increase the mutual inductance of the antenna as well as an insulating interlayer between the insulating layer and the transistor component layer.

However, the addition of the insulating layer with the fine particles of soft magnetic material and the insulating interlayer includes at least two additional steps in the manufacturing process making it more complex than is necessary with longer manufacturing times. Moreover, the fine particles of soft magnetic material are non-standard materials for thin-film transistor manufacturing.

SUMMARY OF THE DISCLOSURE

The present disclosure may provide a monolithically integrated antenna device where no assembly of components is included.

The present disclosure may also provide a wireless tag incorporating a monolithically integrated antenna device.

The present disclosure may also provide an antenna device comprising a chip and an antenna structure where the chip substrate size is the same or larger than that of the antenna structure.

The present disclosure may also provide a monolithically integrated antenna device in which no additional non-standard material layers are required to provide shielding from electromagnetic interference.

In accordance with the present disclosure, there is provided a monolithically integrated antenna device comprising: a substrate having a first surface and a second surface; a transistor component layer comprising at least one electronic component therein; and at least one antenna structure formed on one of: the substrate and the transistor component layer, the antenna structure being configured to operate in a frequency range of between 30 kHz and 2.4 GHz; wherein the substrate is configured to have a size which is the same or larger than the at least one antenna structure; characterized the at least one electronic component in the transistor component layer is configured to be shielded from electromagnetic interference.

Such a monolithically integrated antenna device may allow all components to be formed on a single substrate. In addition, by configuring the at least one electronic component in the transistor component layer to be shielded from electromagnetic interference, electromagnetic radiation does not interfere with the transistor component layer of the device without having to include additional non-standard materials.

While modern ID tag technologies drive the electronics or chip size to smaller and smaller dimensions, by increasing the chip area significantly, it is possible to create a sub-1 GHz monolithic antenna directly "on-chip". This eliminates the need of the assembly process. In this context, monolithic integration means that both the chip and the antenna are manufactured on the same substrate, either in one or in subsequent processes.

In an embodiment, the transistor component layer may be formed side-by-side with the at least one antenna structure on the first surface of the substrate. Such an embodiment can be used for both capacitive and inductive antenna structures.

In an embodiment, the at least one antenna structure is formed in a stack with the transistor component layer and the substrate. Such an embodiment can be used for both capacitive and inductive antenna structures.

The antenna structures may be formed by one of: physical vapor deposition, electroplating and printing.

In an embodiment, the at least one antenna structure comprises a first antenna structure, and, the transistor component layer is formed on the first surface of the substrate with the first antenna structure formed over at least one interlayer formed on the transistor component layer.

In an embodiment, the device further comprises a shielding layer and the at least one interlayer comprises a first interlayer and a second interlayer separated by the shielding layer.

This may allow the antenna or electrode to be shielded from electromagnetic interference.

In an embodiment, the first antenna structure is configured to extend over the at least one electronic component in the transistor component layer to provide shielding thereof.

In an embodiment, a second antenna structure may be formed on the second surface of the substrate.

In such an embodiment, each antenna structure may operate at a different frequency in a single device. For example, the antenna structures may operate at different frequencies within the range of 30 kHz to 2.4 GHz described above. They may operate in the range of 30 kHz to 300 MHz.

In an embodiment, the at least one antenna structure comprises a first antenna structure formed on the first surface of the substrate and the transistor component layer is formed over the first antenna structure.

At least one interlayer may be provided between the first antenna structure and the transistor component layer.

The provision of such an interlayer may provide for both decoupling of components within the structure and planarization ready for the next deposition step.

In an embodiment, a metal layer may be configured to extend over the at least one electronic component in the transistor component layer to provide shielding thereof.

A shielding layer may also be provided in the at least one interlayer which separates it into first and second interlayers.

Such a shielding layer electrically decouples the components in the transistor component layer from the antenna structure.

In an embodiment, the transistor component layer may be formed on the first side of the substrate and the at least one antenna structure is formed on the second side of the substrate. At least one interlayer may be located between the at least one antenna structure and the second surface of the substrate. A shielding layer may also be located within the at least one interlayer.

In an embodiment, routing elements may extend through at least one further layer for connecting to the transistor component layer. Such routing elements may be configured to extend over the at least one electronic component in the transistor component layer to provide shielding thereof.

In an embodiment, the at least one antenna structure may comprise at least two stacked metal layers formed on the substrate. The antenna structure may be formed from three stacked metal layers. Here, the antenna structure is formed side-by-side with the transistor component layer.

A metal layer may be provided which is configured to extend over the at least one electronic component in the transistor component layer to provide shielding thereof.

In accordance with a further aspect of the present disclosure, there is provided an antenna device as described above configured as a dipole antenna device and having an operational frequency range up to 2.4 GHz.

In accordance with another aspect of the present disclosure, there is provided a wireless tag comprising a monolithically integrated antenna device as described above.

BRIEF DESCRIPTION OF THE DRAWINGS

For a better understanding of the present disclosure, reference will now be made, by way of example, to the accompanying drawings in which:—

DETAILED DESCRIPTION OF THE DISCLOSURE

Figure 1:
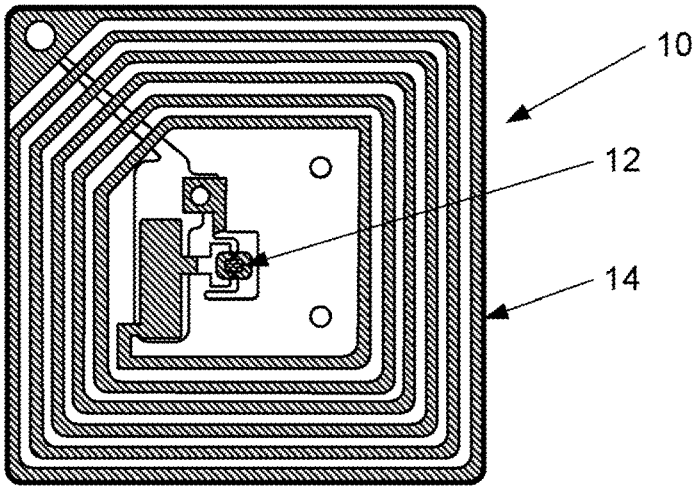
FIG. 1 (Prior Art)
FIG. 1 illustrates a plan view of a conventional wireless ID tag.

The present disclosure will be described with respect to particular embodiments and with reference to certain drawings but the disclosure is not limited thereto. The drawings described are only schematic and are non-limiting. In the drawings, the size of some of the elements may be exaggerated and not drawn on scale for illustrative purposes.

Abbreviations and acronyms used herein include:

"low-k dielectrics" refers to dielectrics having k values in the range of between 2 and 5;

"$V_{DD}$" refers to the supply voltage;

"IC" refers to an integrated circuit or chip;

"TFT" refers to a thin film transistor, referred to as "TFT component", "TFT component layer" or simply "TFT" in the following disclosure;

"SAL TFT" refers to a self-aligned TFT;

"TFIC" refers to a thin film integrated circuit, referred to as "TFIC component" or simply "TFIC";

"RFID" refers to radio frequency identification;

"CAPID" refers to capacitive identification;

"MIM" refers to metal-insulator-metal used in capacitors;

"PVD" refers to physical vapor deposition, and describes a multitude of vacuum deposition processes, such as, sputtering, e-beam, laser ablation and evaporation, where the material transitions from a condensed phase to a vapor phase and then back to a thin film condensed phase; metals and metal oxides can be used for the deposition and "DC-PVD" refers to a PVD process where DC power is applied to a target;

"PECVD" refers to plasma-enhanced chemical vapor deposition (CVD) in which thin films are deposited onto a substrate in a solid state starting from a gaseous state (vapor);

"TFIC substrate" refers to a substrate for the electronics or chip in the TFT component; also described as "flexible substrate" or simply "substrate"—the substrate having a size which is the same or larger than the antenna component formed thereon and on which all processing steps are performed to form the integrated antenna structure of the present disclosure;

"sub-1 GHz" refers to the operating frequency range for the monolithic integrated antenna device in accordance with the present disclosure, and, is between 30 kHz and 1 GHz, e.g., between 30 kHz and 300 MHz;

"monolithically integrated antenna structure", "monolithically integrated antenna device" or "monolithically integrated device" refer to the antenna structure in accordance with the present disclosure in which all processing steps are performed on the same substrate; and "Q-factor" refers to a measure of the bandwidth of an antenna relative to the centre frequency of the bandwidth; antennas with high Q are narrowband and those with low Q are wideband—the antenna structure in accordance with the present disclosure is narrowband.

FIG. 1 illustrates a conventional wireless ID tag 10 showing an integrated circuit (IC) or chip 12 and an antenna coil 14. As can be seen the sizes of the chip 12 and antenna 14 are considerably different. As described above, the chip and antenna are provided as separate components for a tag assembly process, the chip having a size typically smaller than 1 $mm^2$ and the antenna having a size of several $cm^2$.

Figure 2A:
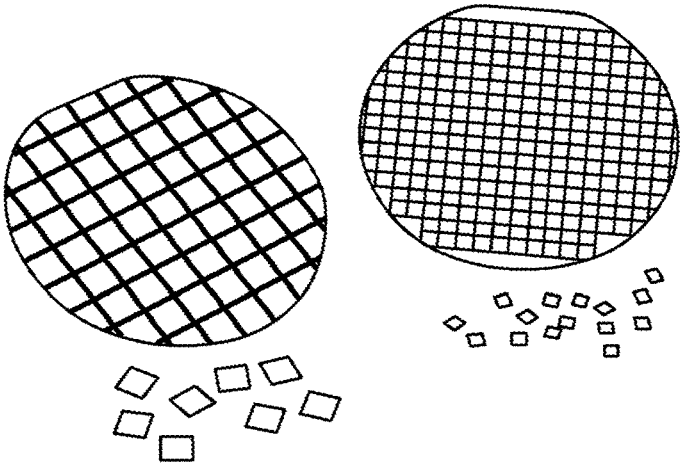
FIG. 2A (Prior Art)
FIG. 2A illustrates conventional chips for ID tag assembly.
Figure 2B:
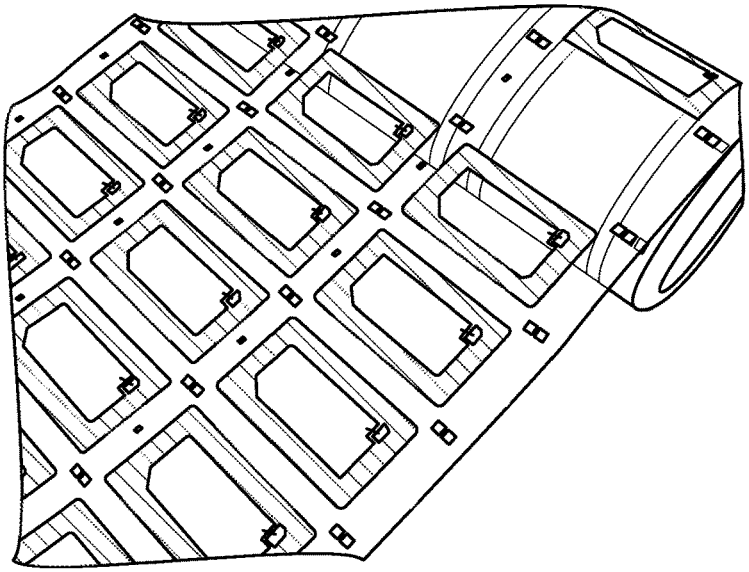
FIG. 2B (Prior Art)
FIG. 2B illustrates antenna sub-components for ID tag assembly.

FIGS. 2A and 2B illustrate the chip and antenna sub-components used in the tag assembly process. Typically, a plurality of chips is provided on a temporary wafer carrier (FIG. 2A) and a plurality of antennas is provided on a temporary paper or film carrier (FIG. 2B). In effect, the chip(s) may be provided in an uncut wafer form on an adhesive layer formed on a carrier layer where the cutting of the chips from the wafer is performed just prior to the pick-and-place process.

Figure 3:
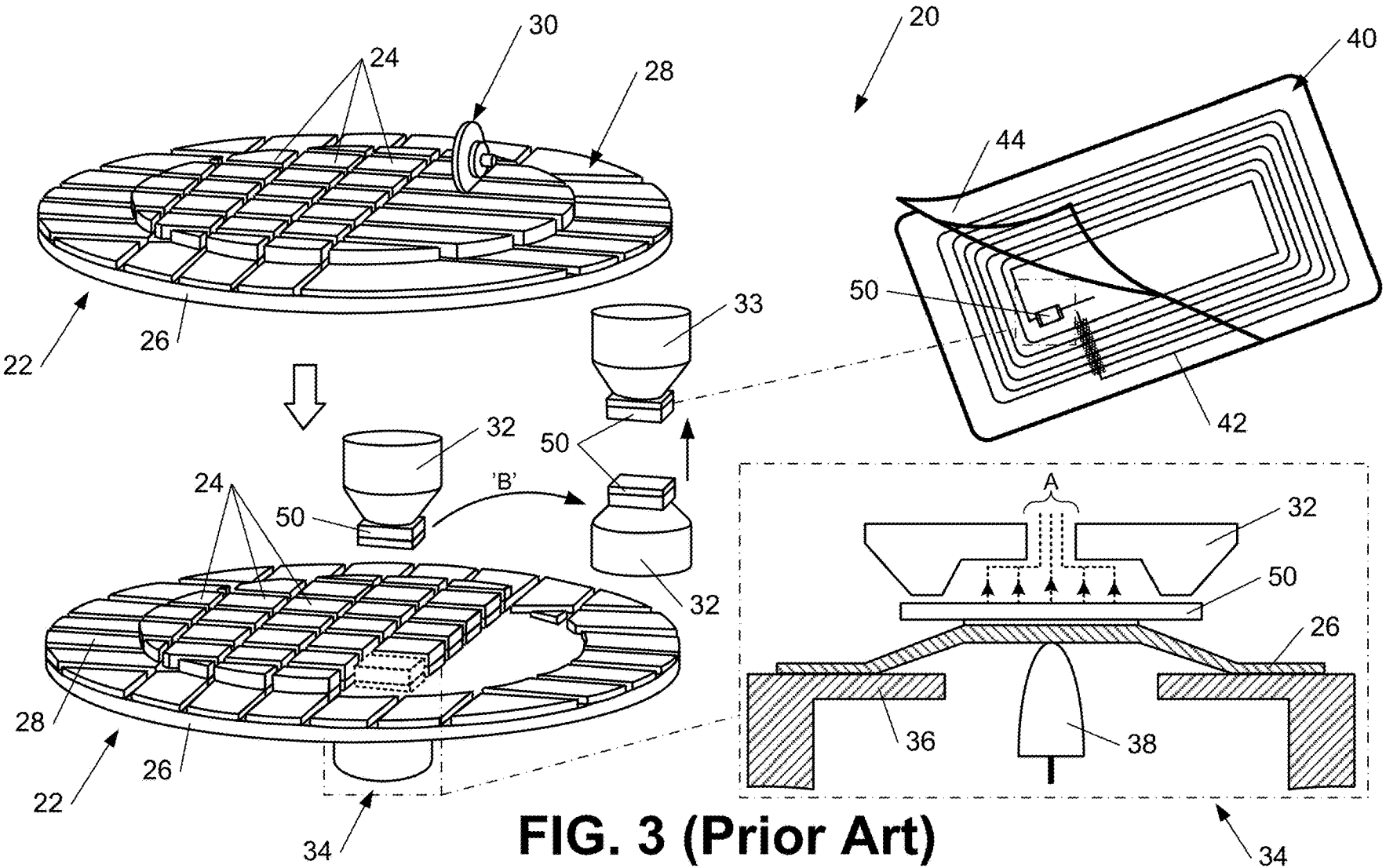
FIG. 3 (Prior Art)
FIG. 3 illustrates the schematics of a conventional assembly process (pick-and-place process).

FIG. 3 illustrates the schematics of a conventional pick-and-place system 20 for the assembly of IC chip and antenna sub-components. A wafer 22 has a plurality of chips 24 mounted on a carrier tape 26 using a layer of adhesive 28. A diamond cutter 30 is used to separate the chips 24 on the wafer 22 prior to being selected and placed in position with respect to an antenna 42 forming part of an RFID tag 40 once separated from its backing sheet 44. A pick-up head 32 of a robot (not shown) is used to select an individual separated chip 50 from the wafer 22 with the assistance of an ejector system 34 and an applied vacuum as indicated by arrows "A". The ejector system 34 comprises an ejector cup 36 and an injector needle 38 which cooperates with the pick-up head 32 to remove the selected chip 50 from the wafer 22. After the selected chip 50 has been picked up, the pick-up head 32 rotates through 180° in the direction of arrow "B" so that the chip 50 is now on top of the pick-up head 32 as shown. A placement head 33 of a robot (also not shown) takes the chip 50 from the pick-up head 32 and places it in the correct location on the RFID tag 40 as shown.

In accordance with the present disclosure, a wireless ID tag is described in which the chip substrate is the same size or larger than that of the antenna. This is contrary to what is currently done in the field as the chips tend to have smaller and smaller dimensions. The chip area of the device according to the present disclosure may be 10 $mm^2$ or larger which allows for the creation of a sub-1 GHz monolithic antenna directly "on-chip" as will be described below.

Figure 4A:
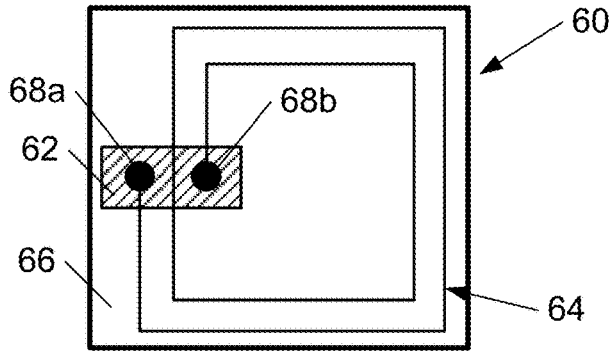
FIG. 4A (Prior Art)
FIG. 4A schematically illustrates a conventional assembly process.

FIG. 4A illustrates a conventional wireless tag assembly 60 where a TFIC component (not shown) is formed on a TFIC substrate 62 and an antenna component 64 is formed on an antenna substrate 66. The TFIC substrate 62 is adhered to the antenna substrate 66 to form electrical connections 68*a*, 68*b* between the TFIC component and the antenna component 64. Connections 68*a*, 68*b* are provided for electrically connecting the TFIC component with the antenna component and comprise chip contact pads provided on the TFIC component together with the corresponding contact pads on the antenna substrate 66.

Figure 4B:
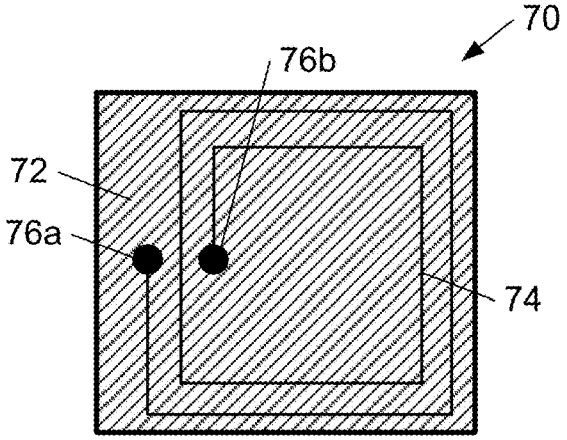
FIG. 4B schematically illustrates a monolithic process, according to example embodiments.

In contrast, in FIG. 4B, a monolithically integrated device 70 according to the present disclosure is shown in which a TFIC component 72 and an antenna component 74 are manufactured on the same substrate as one component. In effect, the antenna component 74 is formed on the TFIC component 72 with connections 76*a*, 76*b* being provided for connecting the TFIC component with the antenna component.

A chip construction for a monolithically integrated device according to one aspect of the present disclosure is described with reference to FIGS. 5A to 5F in which an integrated antenna is formed by additional conductive structures with the chip design. As shown in FIGS. 5A to 5F, the layers of the monolithically integrated device are shown but components within each layer are not shown.

Figure 5A:
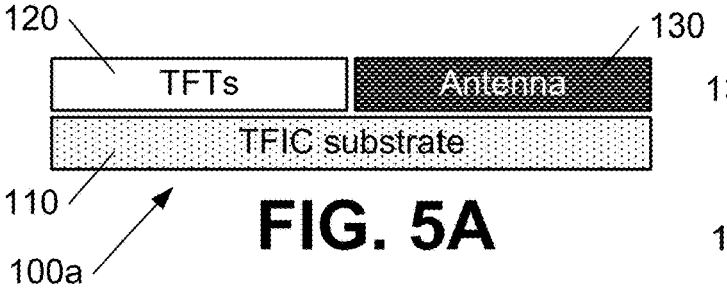
FIG. 5A illustrates a sectioned view of an implementation of a monolithic tag, according to example embodiments.
Figure 5B:
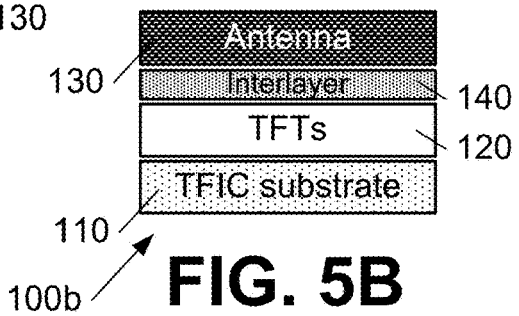
FIG. 5B illustrates a sectioned view of an implementation of a monolithic tag, according to example embodiments.
Figure 5C:
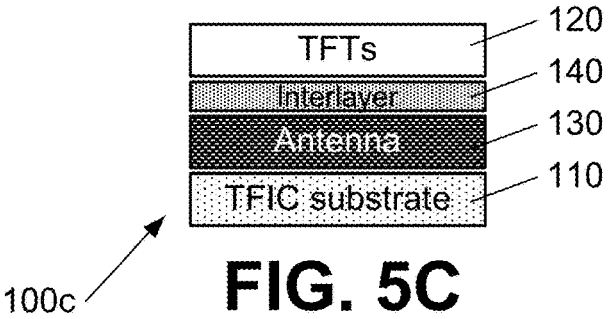
FIG. 5C illustrates a sectioned view of an implementation of a monolithic tag, according to example embodiments.
Figure 5D:
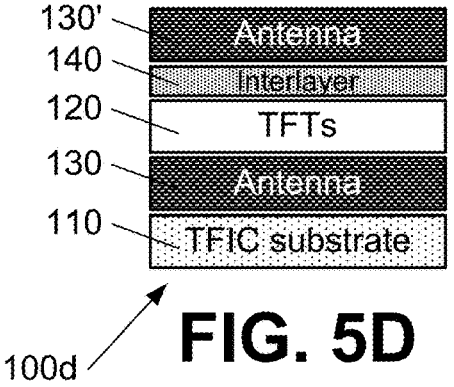
FIG. 5D illustrates a sectioned view of an implementation of a monolithic tag, according to example embodiments.
Figure 5E:
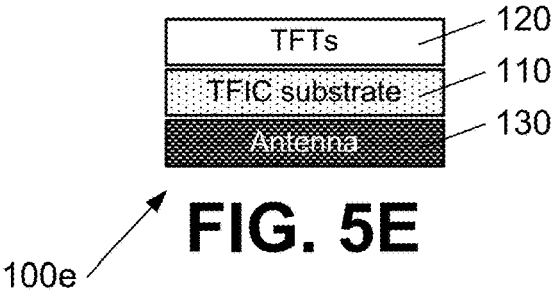
FIG. 5E illustrates a sectioned view of an implementation of a monolithic tag, according to example embodiments.
Figure 5F:
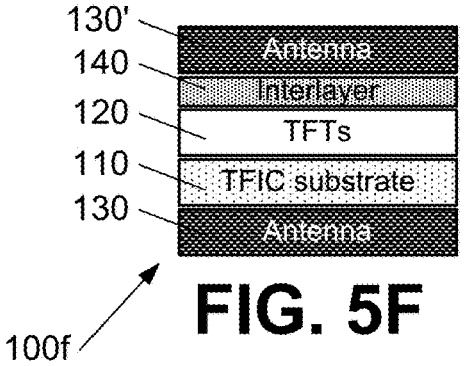
FIG. 5F illustrates a sectioned view of an implementation of a monolithic tag, according to example embodiments.

The additional conductive structures may be integrated in various embodiments relative to the chip electronics (i.e. thin-film transistor (TFT component or TFT) layer):

Side-by-side with the chip electronics in the TFIC substrate (as shown in FIG. 5A);

Above the chip electronics in the TFIC substrate (as shown in FIG. 5B);

Below the chip electronics in the TFIC substrate (as shown in FIG. 5C);

Both below and above the chip electronics in the TFIC substrate (as shown in FIG. 5D);

Below the chip substrate, that is, on an opposite side of the TFIC substrate to the TFT component layer (as shown in FIG. 5E); and Below the chip substrate and above the chip electronics in the TFIC substrate (as shown in FIG. 5F).

FIG. 5A illustrates a first embodiment of a monolithically integrated device 100*a* according to the present disclosure which comprises a TFIC substrate 110 on which a TFT component 120 is formed side-by-side with an antenna structure 130. The type of antenna and its formation is described in more detail below.

FIG. 5B illustrates a second embodiment of a monolithically integrated device 100*b* according to the present disclosure which comprises a TFIC substrate 110 on which a TFT component 120 is formed. An antenna structure 130 is formed over the TFT component 120 but is separated therefrom by an interlayer 140.

FIG. 5C illustrates a third embodiment of a monolithically integrated device 100*c* according to the present disclosure which comprises a TFIC substrate 110 on which an antenna component 130 is formed. A TFT component 120 is formed over the antenna structure 130 but is separated therefrom by an interlayer 140.

FIG. 5D illustrates a fourth embodiment of a monolithically integrated device 100*d* according to the present disclosure which comprises a TFIC substrate 110 on which a first antenna structure 130 is formed. A TFT component 120 is formed over the first antenna structure 130. A second antenna structure 130' is formed over the TFT component 120 but is separated therefrom by an interlayer 140.

FIG. 5E illustrates a fifth embodiment of a monolithically integrated device 100*e* according to the present disclosure which comprises a TFIC substrate 110 over which a TFT component 120 is formed with an antenna structure 130 being formed on the opposite side of the TFIC substrate to that of the TFT component 120. Although not shown, an interlayer may be provided between the antenna structure 130 and the TFIC substrate 110.

FIG. 5F illustrates a sixth embodiment of a monolithically integrated device 100*f* according to the present disclosure which comprises a TFIC substrate 110 over which a TFT component 120 is formed with an antenna structure 130 being formed on the opposite side of the TFIC substrate to that of the TFT component 120. A second antenna structure 130' is formed over the TFT component 120 but is separated therefrom by an interlayer 140. Although not shown, an interlayer may be provided between the second antenna structure 130' and the TFIC substrate 110.

In each embodiment, the additional conductive structures may form capacitive or inductive antennas.

For inductive antennas, the integrated antenna structures are conductive structures configured such that a change in current through one wire of a conductive structure (e.g. a reader antenna structure) induces a voltage across the ends of a wire of another conductive structure (e.g. a tag antenna structure) through electromagnetic induction and vice versa. The amount of inductive coupling between two conductors is measured by their mutual inductance. The coupling between two wires can be increased by winding them into coils and placing them close together on a common axis, so the magnetic field of one coil passes through the other coil. The antenna structure (or coil) forms an electrical connection with the chip electronics as shown in FIG. 6A.

Figure 6C:
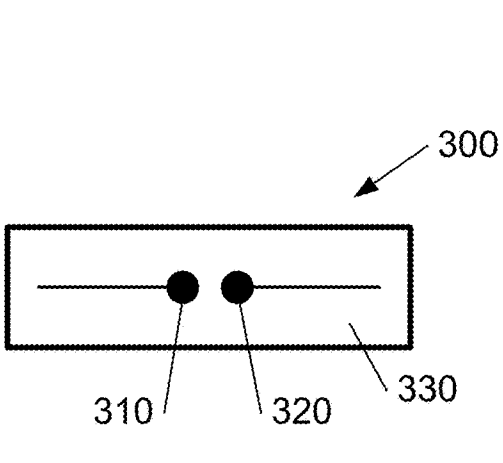
FIG. 6C illustrates a dipole antenna layout, according to example embodiments.
Figure 6B:
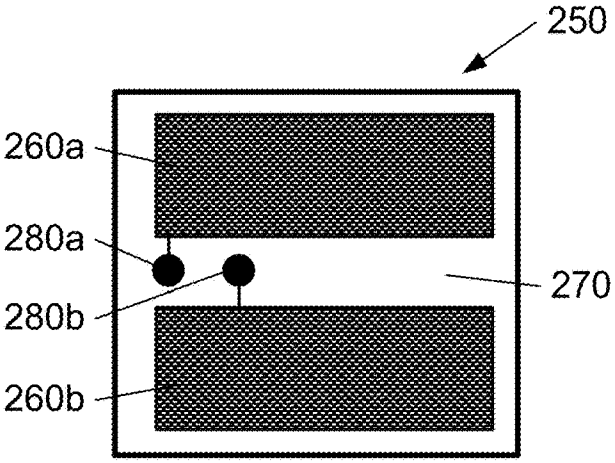
FIG. 6B illustrates a capacitive antenna layout, according to example embodiments.
Figure 6A:
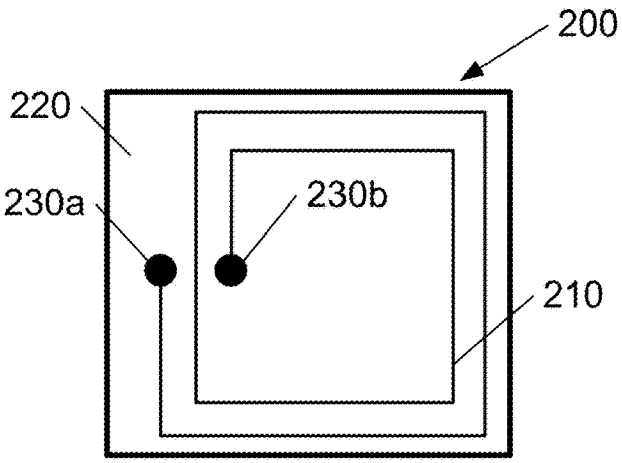
FIG. 6A illustrates an inductive antenna layout, according to example embodiments.

In FIG. 6A, an inductive antenna structure 200 is shown which comprises an inductive coil 210 formed on a TFIC component 220 with electrical connections 230*a*, 230*b* connecting with electronics in the TFIC component 220.

For capacitive antennas, the integrated antenna structures are conductive structures configured such that a change in the electric field between the structures induces displacement currents within the structures. The antenna structure (plates) forms an electrical connection with the chip electronics (FIG. 6B).

In FIG. 6B, a capacitive antenna structure 250 is shown which comprises first and second plates 260*a*, 260*b* formed on a TFIC component 270 with electrical connections 280*a*, 280*b* connecting respective ones of the first and second plates 260*a*, 260*b* with electronics in the TFIC component 270.

Each of the inductive antenna structure 200 and the capacitive antenna structure 250 shown in respective ones of FIGS. 6A and 6B is configured to operate in a frequency range of between 30 kHz and 1 GHz.

Each embodiment in accordance with the present disclosure is described in more detail below.

In the side-by-side configuration shown in FIG. 5A, the TFT component and antenna structure are fabricated side-by-side directly onto the TFIC substrate. Both inductive and capacitive antennas are possible.

Capacitive antennas may be formed by physical vapor deposition (PVD) or by printing. Inductive antennas may also be formed by printing as well as plating. For both capacitive and inductive antennas, low power TFICs are proposed and for inductive antennas, high conductivity layers may be used, as described below.

As described above, there are issues with antenna metal conductivity. In effect, for an inductive antenna, the conductivity may be high resulting in a large Q-factor in the range of 5 to 30.

For typical PVD metals, such as, molybdenum, molybdenum-chromium, copper, gold and aluminum, layer thicknesses in excess of the μm range are used. Such thick metals are uncommon in TFIC manufacturing. Much thinner layers are used in a TFT stack 50 to 250 nm. A TFT stack customization is therefore required to accommodate for conductivity requirements of monolithic inductive antennas which includes an integration process for thicker metals, that is, greater than 1 μm thick; material change to higher conductivity metals, for example, aluminum, copper or multi-metal structures, such as MoCr/Al/MoCr, Mo/Al/Mo and Ti/Al/Ti).

Returning now to FIG. 5B where the antenna structure 130 is located above the TFIC substrate 110, both inductive and capacitive configurations are possible. The antenna structures may be formed by printing or plating, for inductive configurations, and by PVD or printing, for capacitive configurations. As compared to the side-by-side configuration shown in FIG. 5A, additional considerations are to be taken into account when the antenna structure is positioned above or below the RFIC substrate. For the capacitive configuration, at least some parasitic capacitive coupling between the antenna and the TFIC components may be avoided.

Figure 8:
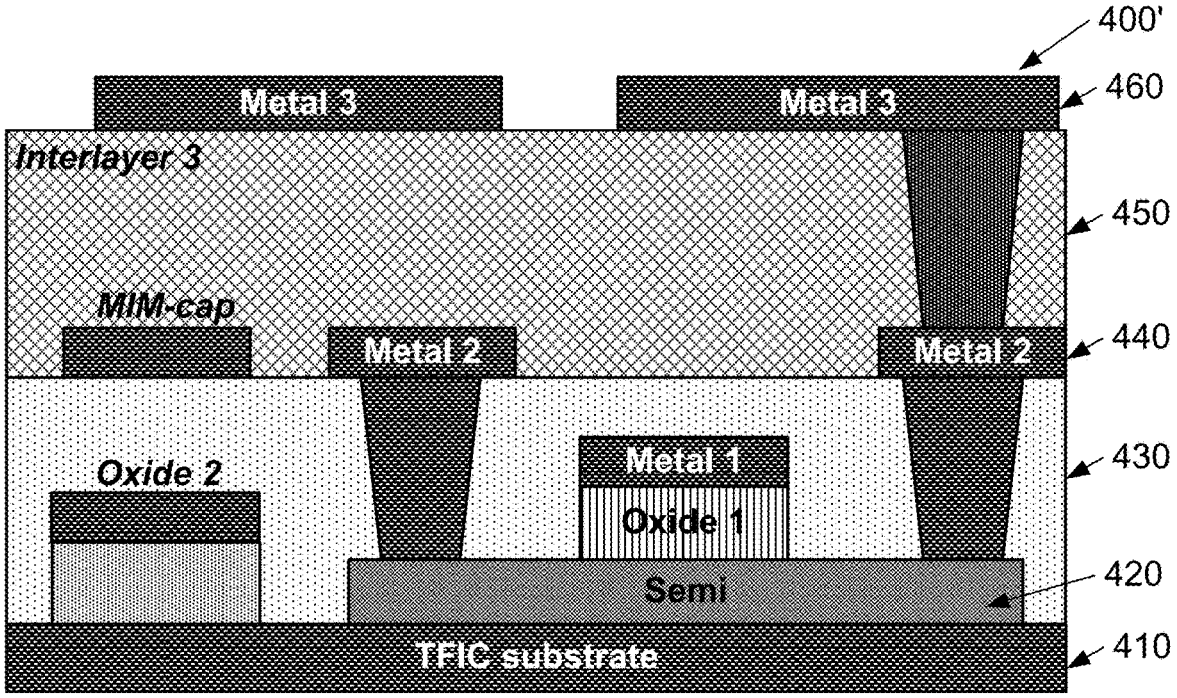
FIG. 8 illustrates a cross-sectioned view, according to example embodiments.

With the antenna structure on top of the TFT component as shown in FIG. 5B, there may be parasitic coupling between the electrodes of the antenna structure and the metals of the TFT component. This can be mitigated by using a thicker dielectric layer (interlayer 3) as shown in FIG. 8, to de-couple the antenna structure from the TFIC component. The capacitive coupling between the antenna structure (tag antenna) and the TFT component may be at least 100 times smaller than the capacitive coupling between the tag (tag antenna) and a reader (reader antenna). For example, when the capacitive coupling between the tag antenna and the reader antenna is of the order of 20 pF, the capacitive coupling between the tag antenna and the TFT component may be smaller than 0.2 pF. This corresponds to an interlayer thickness in the range of between 2 to 50 μm when using low-k dielectrics which is significantly thicker than typical dielectric layers of TFT technology.

FIG. 6C illustrates a dipole antenna 300 in which two dipoles 310, 320 are formed on a substrate 330. Such a dipole antenna arrangement effectively has the same architecture as shown by the cross-sections as described with respect to FIGS. 7 to 18B, below. Typically, such a dipole antenna can increase the operating range up to 2.4 Ghz, that is, above the sub-GHz level.

Figure 7:
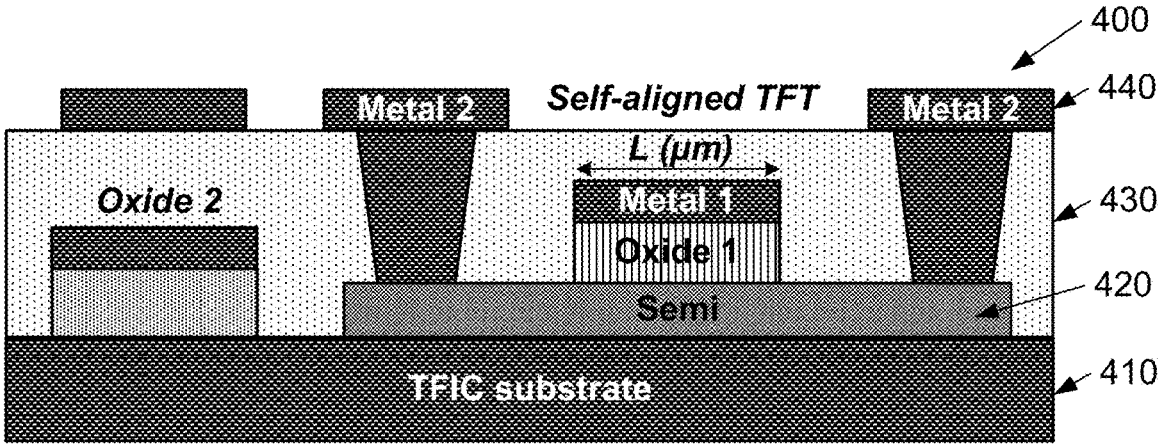
FIG. 7 illustrates a cross-sectioned view, according to example embodiments.

A cross-section of a metal-oxide TFT architecture 400 is shown in FIG. 7. A 3-metal layer transistor technology using Indium-Gallium-Zinc-Oxide (IGZO) as n-type semiconductor 420 is shown, and, the transistor is a "so-called" self-aligned architecture implying non-overlapping source-drain to gate contacts reducing the parasitic capacitance. For the embodiment shown in FIG. 7, a TFIC substrate 410 forms the base for the architecture 400. Afterwards IGZO is sputtered by DC-PVD followed by a step to define the active semiconductor area. In a further step 100 nm or 50 nm PECVD silicon dioxide ($SiO_2$) is deposited as a gate dielectric at a deposition temperature of 250° C. Afterwards, 100 nm of molybdenum (Mo) is deposited as gate-metal. The gate/dielectric stack is patterned within the same step. Subsequently, 400 nm CVD $S_xiN_x$ is deposited (but any other suitable decoupling dielectric may be used as an alternative). The CVD $S_xiN_x$ fulfills the dual purpose of intermetal dielectric and doping the IGZO with hydrogen in the areas not covered by the gate/dielectric stack. These steps form layer 430.

Contact holes for the Source-Drain (SD) contacts are opened up by dry etching and 100 nm Mo is deposited and patterned to define the SD-contacts, indicated as "Metal 2" and referenced as 440 in FIG. 7.

Substrate 410, layer 430 with its semiconductor component 420, the contact holes for the SD metal or contacts ("Metal 2") 440 form a TFT stack on substrate 410.

In FIG. 8, the TFT stack of FIG. 7 was encapsulated with a dielectric material to form "Interlayer 3" as shown by layer 450. The dielectric material layer 450 may comprise photo-cross linkable polymers, but other suitable low k dielectric materials may be used. A third 100 nm thick molybdenum-chromium (MoCr) metal layer ("Metal 3"), indicated by 460, was deposited on top and patterned to form an antenna 460. All process steps in the backplane process stay below a thermal budget of 300° C. The final TFT architecture 400' has a thickness of 35 μm.

Figure 9:
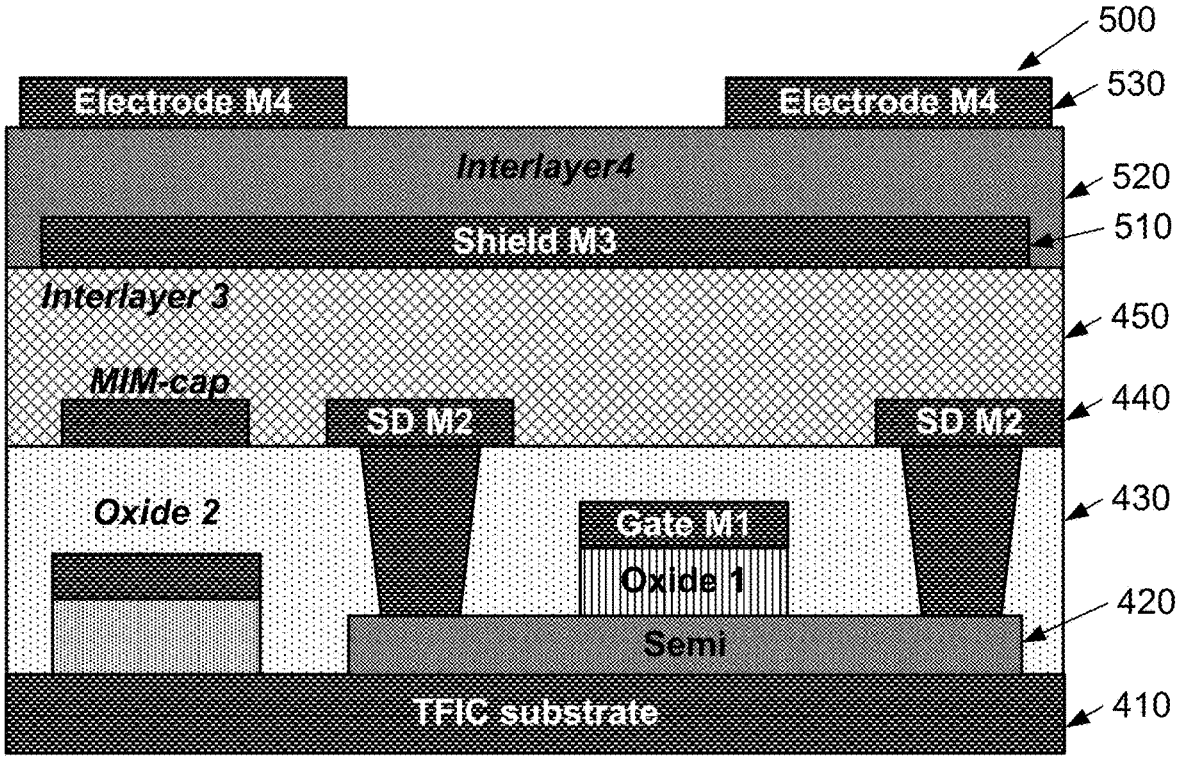
FIG. 9 illustrates a cross-sectioned view, according to example embodiments.

Parasitic coupling between the electrodes and the metals of the TFT component can also be reduced by providing additional shielding to de-couple the antenna structure from the TFIC component. This requires an isolated metal plate to be placed between the TFIC component and the antenna structure. This can be achieved by identifying and shielding components causing the largest parasitic capacitances or by shielding the entire TFIC component using a continuous shielding layer as shown in FIG. 9. This shielding may also be used to reduce electromagnetic interference at the electronic components.

In FIG. 9, a metal-oxide TFT architecture 500 is shown which is similar to that shown in FIG. 5C. Components which have been previously described with reference to FIGS. 7 and 8 have the same reference numbers.

In the embodiment of FIG. 9, a shielding layer 510 is placed over layer 450 of the TFT architecture 400', as described above with reference to FIG. 8, and is then encapsulated with a further dielectric material layer 520 ("Interlayer 4"). The further dielectric material layer 520 may comprise photo-cross linkable polymers, but other suitable low k dielectric materials may be used. An electrode layer 530 ("Electrode M4") is formed over the layer 520 in a similar way to the electrode layer 450 as described above with reference to FIG. 8.

The shielding layer 510 can either be connected to the power supply or ground. In addition, to provide better decoupling, a capacitor having a value in the range of 1 pF$<C_{AB}<C_{CAPID}/2$ may be included in the implementation shown in FIG. 9 and connected to the connection nodes A and B of the TFT component and where $C_{AB}$ corresponds to the capacitance of the capacitor at nodes A and B and $C_{CAPID}$ corresponds to the capacitive coupling between the tag (tag antenna) and the reader (reader antenna).

Figure 10:
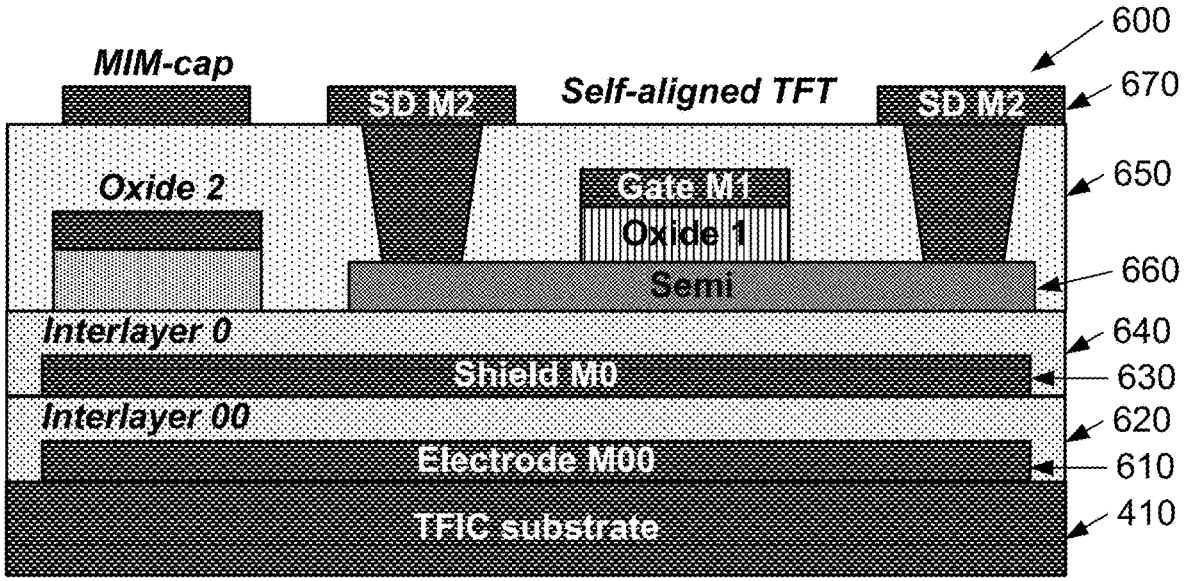
FIG. 10 illustrates a cross-sectioned view, according to example embodiments.

Overlap of the TFIC component and the antenna structure can be minimized to reduce at least some coupling, for example, identification and re-design of components with the largest parasitic coupling can be performed. For example, long metal lines can be made narrower and shorter wherever possible without compromising the electrical properties (i.e. conductivity).

Where the antenna structure is fabricated below the TFIC component as shown in FIG. 10, both inductive and capacitive antennas are possible. For capacitive antennas, the fabrication method may include using PVD, and, for inductive antennas, the fabrication method may include printing. However, in addition to the issues described above, both capacitive and inductive antennas tend to have a non-planar surface before the TFT component. A planarization layer is provided and thick inter-metal dielectrics are used to de-couple the metals.

For capacitive antennas, a PVD metal layer is used to form the antenna plate below the chip. In a specific case of a dual-gate TFT architecture, this PVD metal may be the same as the back-gate electrode layer.

Dipole antennas are also possible using the TFIC component as shown in FIG. 10, and, such antennas can be manufactured in the same way as inductive and capacitive antennas.

The thickness of the antenna structure is important, especially for the inductive implementation, where conductivity requirements dictate the use of a thicker layer. Any layer thicker than 200 nm would result in a non-planar surface prohibited for the subsequent TFT fabrication. To combat the non-planarity, a planarization layer may be added between the antenna structure and the TFT component (not shown). The material from which the planarization layer is made is required to withstand temperatures generated by the TFT components (typically, up to 400° C.) as well as photolithography chemistry of the subsequent process.

Figure 11:
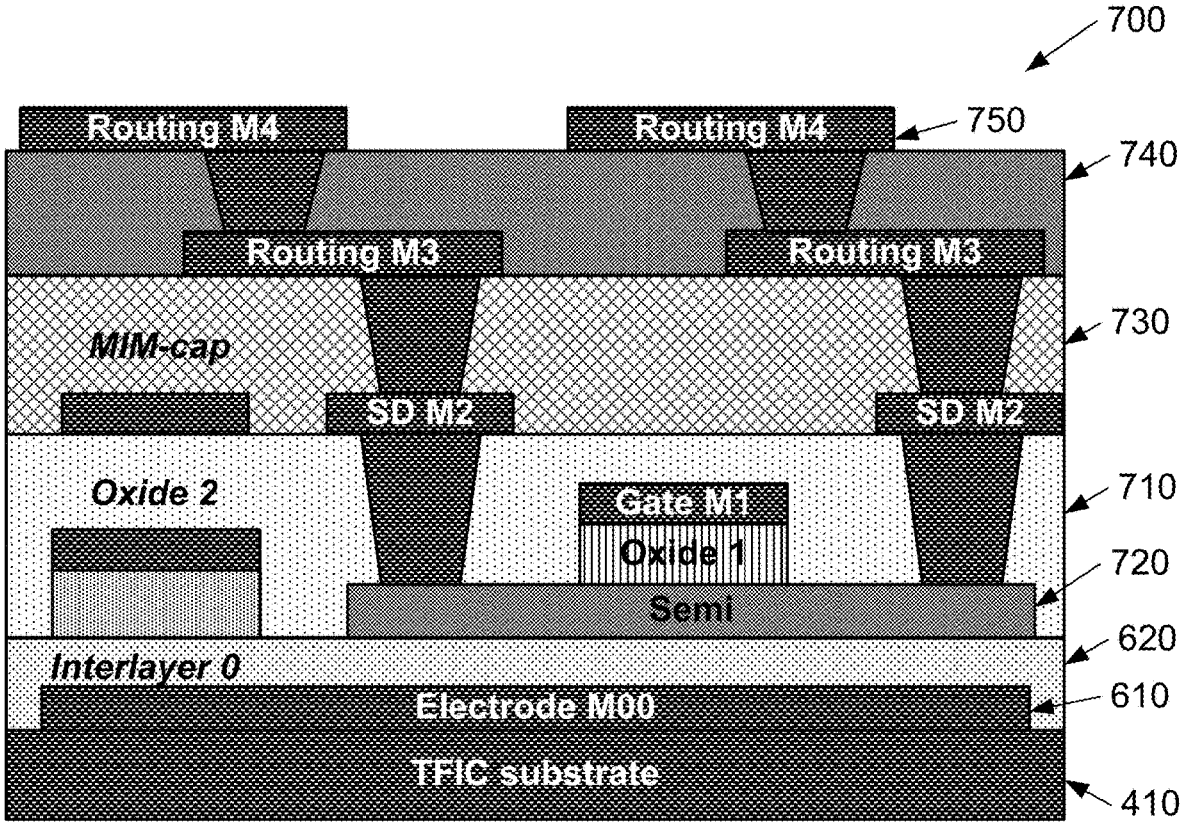
FIG. 11 illustrates a cross-sectioned view, according to example embodiments.

Two options may be implemented to reduce the parasitic coupling, namely: adding a shielding layer between the antenna structure and the TFIC component as illustrated in FIG. 10; and using higher-level metals for the chip routing as shown in FIG. 11.

Referring to architecture 600 of FIG. 10, the TFIC substrate 410 is the same as described above with reference to FIGS. 7 to 9. A 100 nm metal (MoCr) layer is deposed and patterned to form an electrode or antenna 610 ("Electrode M00"). A dielectric layer 620 of $SiO_2$ ("Interlayer 00") is deposited to decouple the antenna 610. A shielding layer 630 ("Shield M0") is formed on the dielectric layer 620 and is encapsulated by a dielectric layer 640 ("Interlayer 0"). A layer 650 including the semiconductor 660 is formed on the dielectric layer 640 in a similar way to that described above with reference to layer 430 in FIGS. 7 to 9. SD metal or contacts 670 ("SD M2") are formed over the layer 650 as shown. Again, the thermal budget of 300° C. is not exceeded.

FIG. 11 illustrates an architecture 700 comprising a TFIC substrate 410, electrode or antenna 610 ("Electrode M00") and dielectric layer 620 ("Interlayer 0") of FIG. 9. In this embodiment, layer 710 with its semiconductor 720 is formed in a similar way to layer 430 as described above with reference to FIG. 7. A dielectric layer 730 formed over the layer 710 has routing ("Routing M3") provided for connections to through interlayer 740 to routing metal or elements 750 ("Routing M4"). Again, the thermal budget of 300° C. is not exceeded.

Figure 12:
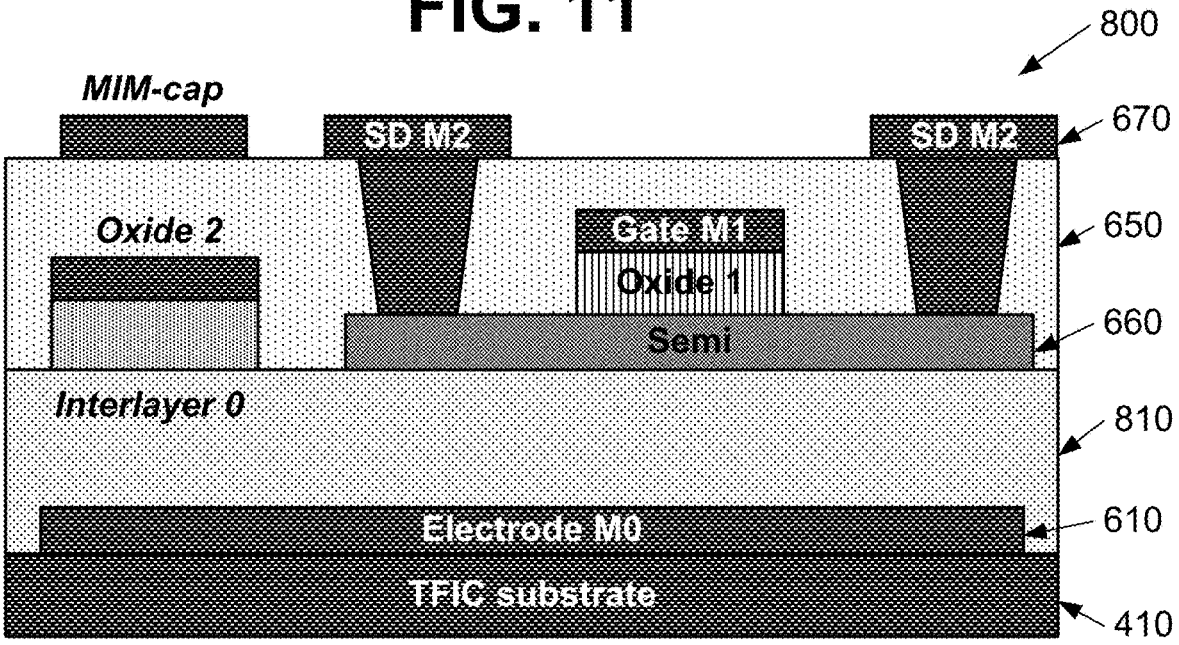
FIG. 12 illustrates a cross-sectioned view, according to example embodiments.

Finally, the use of planarization layer as a de-coupling layer may be implemented as shown in FIG. 12. FIG. 12 illustrates an architecture 800 which is similar to architecture 600 of FIG. 10 but without the shielding layer 630. Dielectric layer 810 ("Interlayer 0") serves two functions, namely, that of planarization and of de-coupling, and comprises a very thick dielectric layer, for example, a photo-cross linkable polymers, but other suitable low k dielectric materials may be used. Such a layer can be considered to be the same as layers 620 and 640 in FIG. 10 which have been merged to form a single layer.

As shown in FIGS. 5D and 5F, two antennas 130, 130' are integrated on the same TFIC component 110 and implement a dual-antenna TFIC tag where each antenna provides a separate and distinct functions. FIG. 5F is effectively the two-antenna version of FIG. 5E, and, FIG. 5D is similar to FIG. 5C but forms a two-antenna version thereof.

In accordance with the present disclosure, there are three methods which can be used for the manufacture of a thin-film tag. However, the main challenge is to obtain high antenna conductivity.

Electroplating methods may be used to form the conductive structures for monolithically integrated antennas. Electroplated metal films are deposited from metal cations reduced by the applied electric current. An important feature of this method is the use of a seed layer which is added to the monolithic structure at each point where the antenna is to be formed by electroplating, and, over which subsequent electroplating is performed. It is important that a uniform seed layer, for example, using a TiW/Cu composition, is deposited with PVD on the stack of layers forming the monolithic device to enable uniform electroplating. Subsequently, photoresist is spun and developed on the wafer. Electroplating of, for example, copper, is performed in the openings of the resist to define the antenna structure. Resist is subsequently stripped. Afterwards, the seed layer is etched leaving an antenna structure on top of a TFT stack.

PVD antenna structures may be deposited either as part of the TFT stack, or in a subsequent deposition. In the case, when antenna is deposited as a part of the TFT stack, two or more metallization layers, for example, gate metal, source drain metal, routing metal, may be stacked on top of one another to increase the integrated antenna conductivity. This may be achieved by selectively removing dielectric and semiconductor layers of the TFT stack in the antenna area as shown in FIGS. 13A and 13B 13.

Figure 13A:
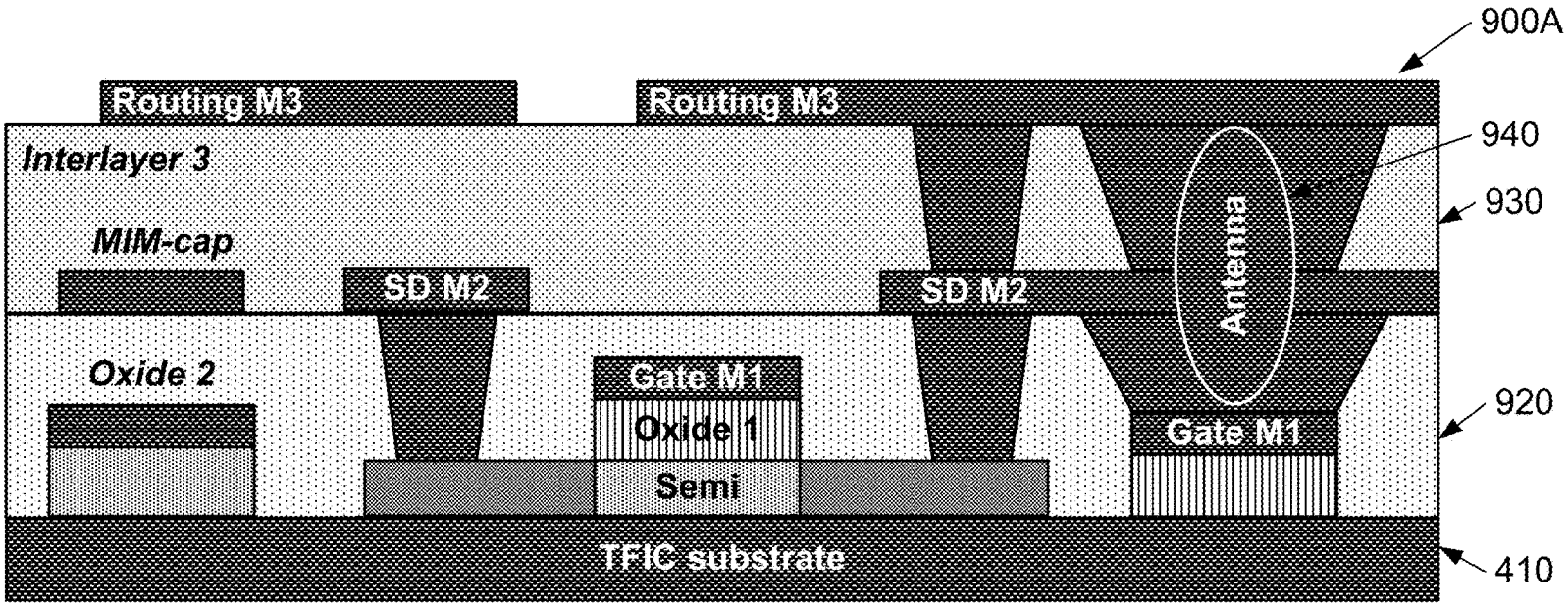
FIG. 13A illustrates a sectioned view of an implementation of a monolithic tag with side-by-side integration of a thin film transistor component with an antenna structure, according to example embodiments.

In FIG. 13A, a single-gate SAL TFT architecture or implementation 900A is shown in which three stacked metals (gate metal "Gate M1", a source-drain metal "SD M2" and routing metal "Routing M3") are used for antenna forming. Layer 920 is formed on RFIC substrate 410 with layer 930 being formed over layer 920. Gate metal "Gate M1" and source-drain metal "SD M2" layer merge to form antenna 940. Direct contact between the three stacked metals (gate metal, source-drain metal and routing metal) is achieved by selective removal, for example by etching, of dielectric layers present on the gate metal layer, before depositing the source-drain metal layer. Once the antenna structure has been formed, a side-by-side embodiment similar to that shown in FIG. 5A is obtained.

Figure 13B:
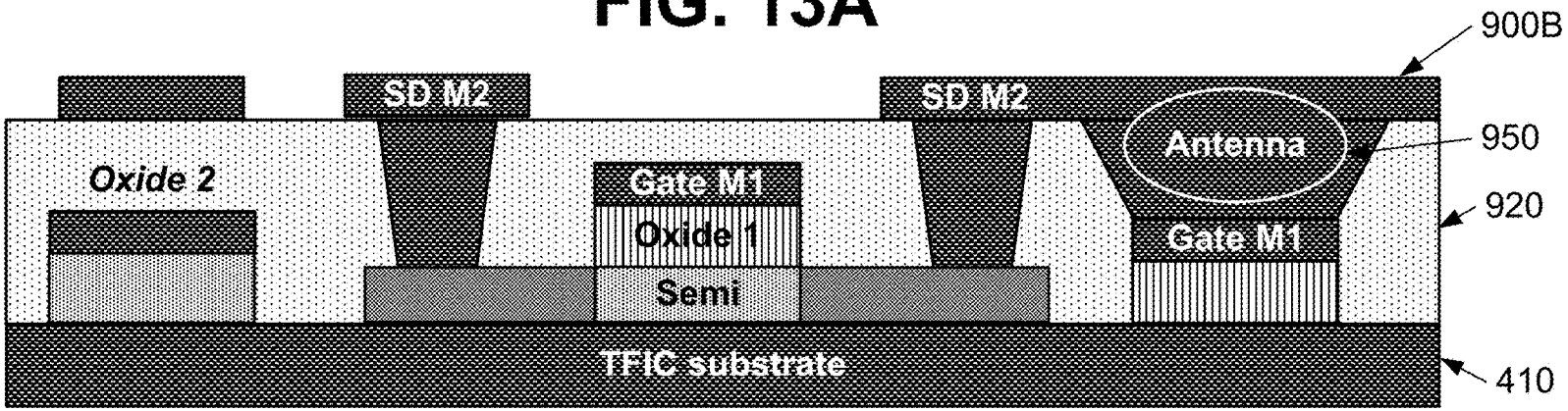
FIG. 13B illustrates a sectioned view of an implementation of a monolithic tag with side-by-side integration of a thin film transistor component with an antenna structure, according to example embodiments.

Similarly, in FIG. 13B, a dual-gate SAL TFT architecture or implementation 900B is shown in which two stacked metals (gate metal "Gate M1" and source-drain metal "SD M2") are used for antenna forming. Layer 920 is formed on RFIC substrate 410 with a gate metal "Gate M1" and source-drain metal "SD M2" merging to form antenna 950. Direct contact between the stacked metals (gate metal and source-drain metal) is achieved by selective removal, for example by etching, of dielectric layers present on a metal layer, before depositing a subsequent metal layer to form the side-by-side embodiment as described generally with respect to FIG. 5A.

In effect, in FIGS. 13A and 13B, there is selective removal of dielectric and semiconductor layers, that is, non-metal layers, to allow the deposition of the antenna structure within the monolithic integrated stack.

Figure 14:
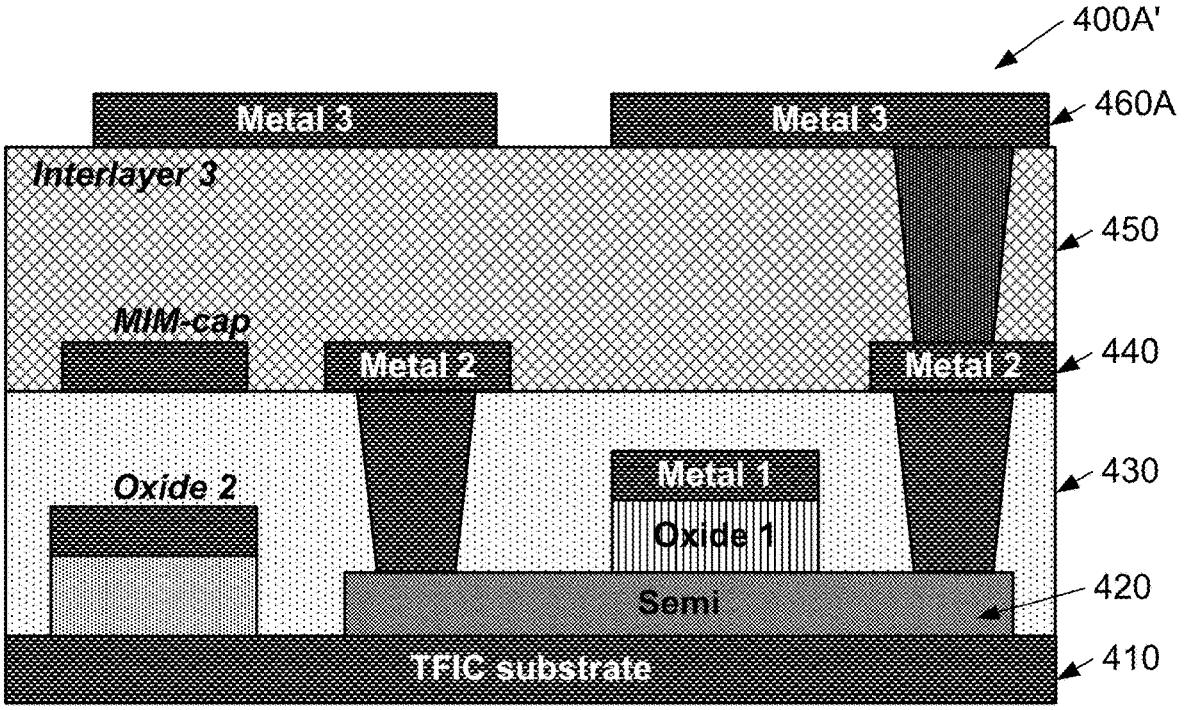
FIG. 14 is similar to FIG. 8 but providing shielding for the components, according to example embodiments.

FIG. 14 illustrates architecture 400A' which is similar to architecture 400' shown in FIG. 8. Components previously described with respect to architecture 400' in FIG. 8 are referenced the same. In FIG. 14, the metal layer ("Metal 3") or antenna 460A is configured to shield electronic components in the TFIC component layer 430. The electronic components are represented by the "Metal 1/Oxide 1" stack formed of semiconductor 420 as shown. In comparison to FIG. 8, the electronic components are shielded by the antenna 460A to reduce electromagnetic interference thereat.

Figure 15:
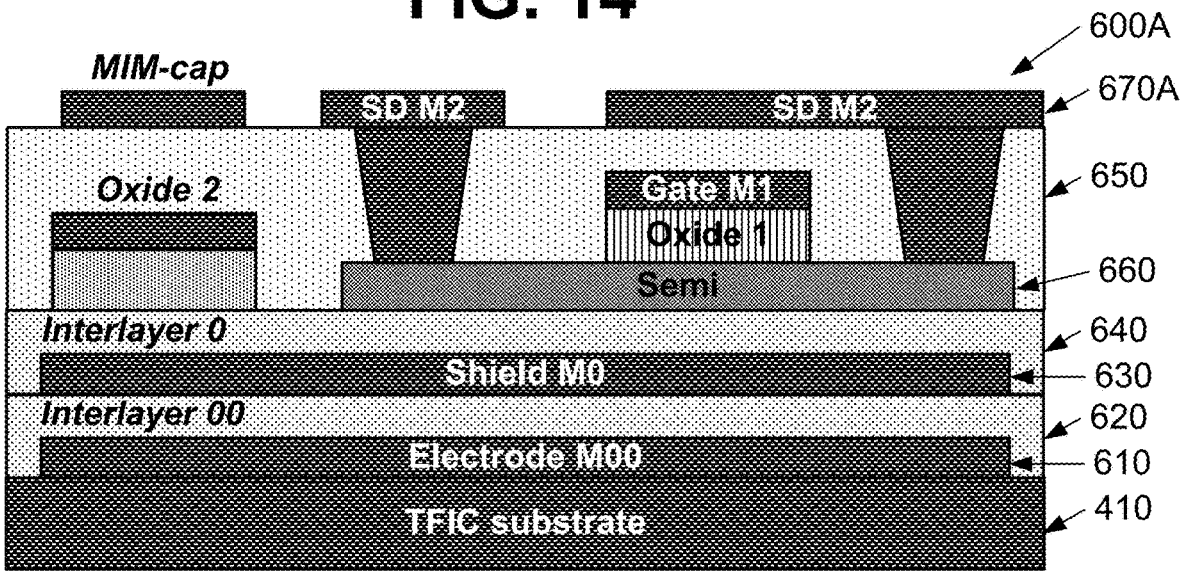
FIG. 15 is similar to FIG. 10, but provides additional shielding for the components, according to example embodiments.

FIG. 15 illustrates architecture 600A which is similar to the architecture 600 shown in FIG. 10. Components previously described with respect to FIG. 10 are referenced the same. In FIG. 15, SD metal or contacts 670A ("SD M2") extends over electronic components ("Gate M1/Oxide 1" stack) of semiconductor 660 as shown. In comparison to FIG. 10, the electronic components are shielded by the SD metal or contacts 670A to reduce electromagnetic interference thereat.

Figure 16:
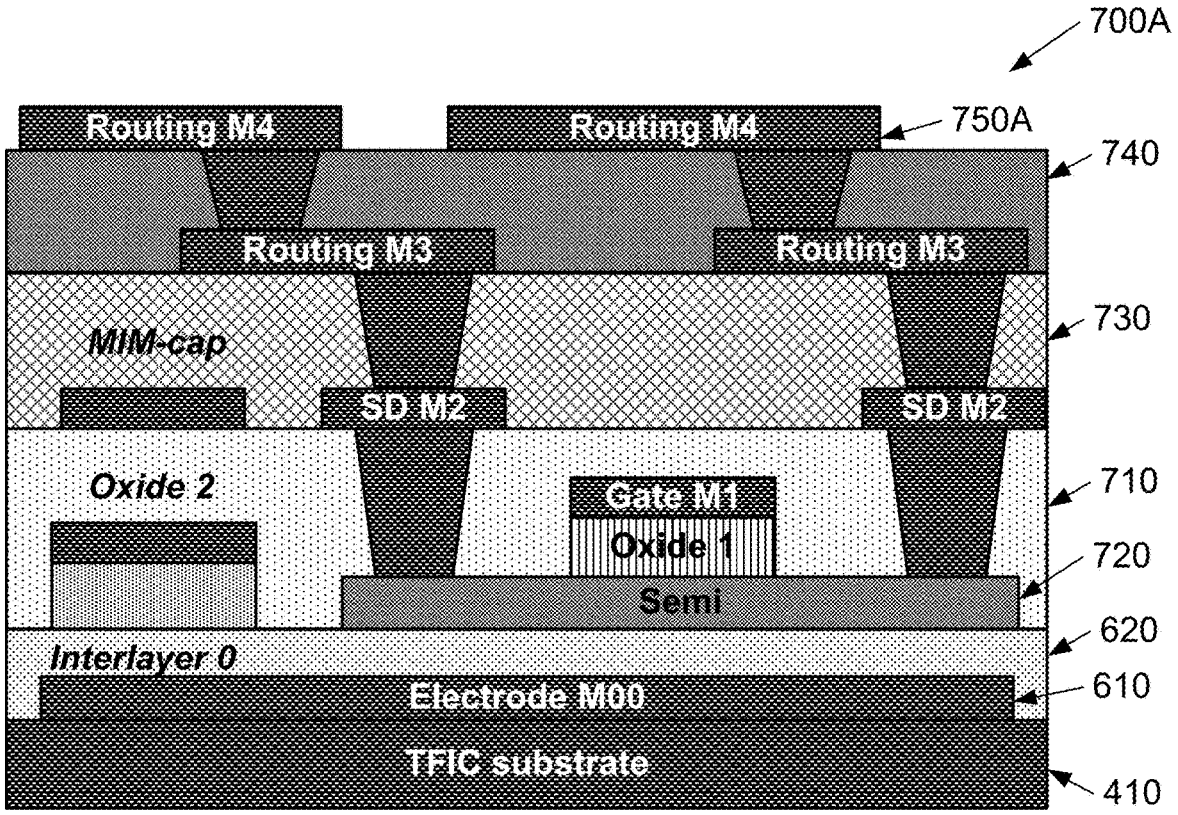
FIG. 16 is similar to FIG. 11, but provides additional shielding for the components, according to example embodiments.

FIG. 16 illustrates an architecture 700A which is similar to architecture 700 shown in FIG. 11. Components previously described with respect to FIG. 11 are referenced the same. In FIG. 16, routing metal 750A ("Routing M4") extend over electronic components ("Gate M1/Oxide 1" stack) of semiconductor 720 as shown. In comparison to FIG. 11, the electronic components are shielded by the routing metal or elements 750A to reduce electromagnetic interference thereat.

Figure 17:
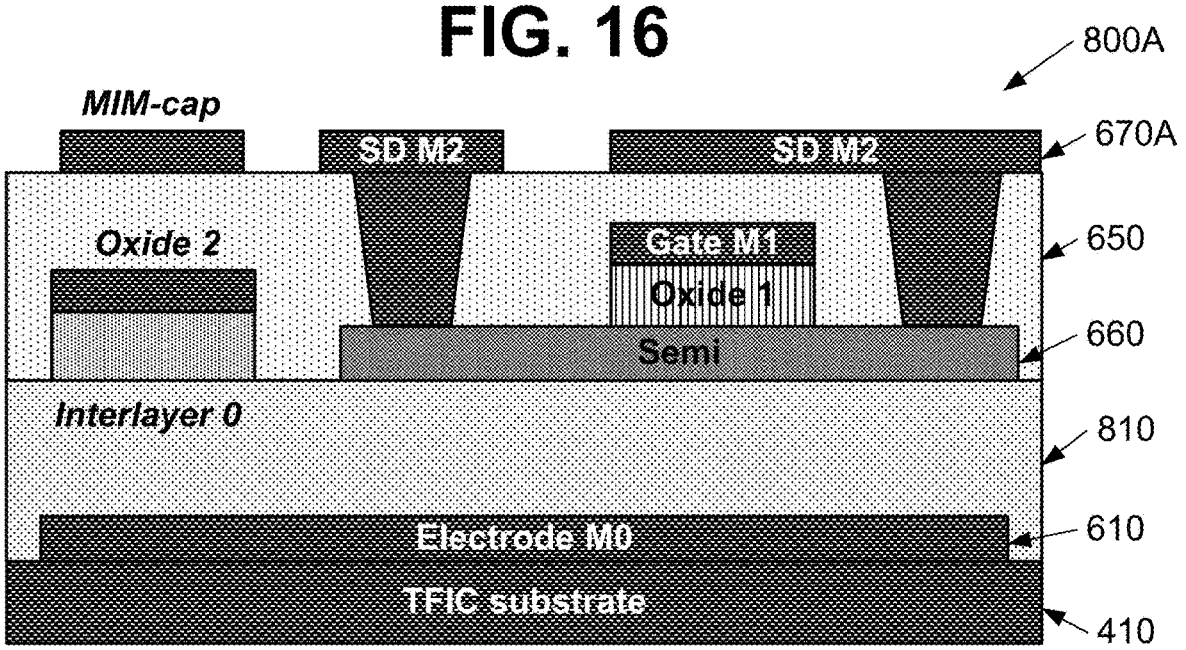
FIG. 17 is similar to FIG. 12, but provides additional shielding for the components, according to example embodiments.

FIG. 17 illustrates architecture 800A which is similar to architecture 800 shown in FIG. 12. Components previously described with respect to architecture 800 are referenced the same. In FIG. 17, SD metal or contacts 670A ("SD M2") extend over electronic components ("Gate M1/Oxide 1" stack) of semiconductor 660 as shown. In comparison to FIG. 12, the electronic components are shielded by the SD metal or contacts 670A to reduce electromagnetic interference thereat.

Figure 18A:
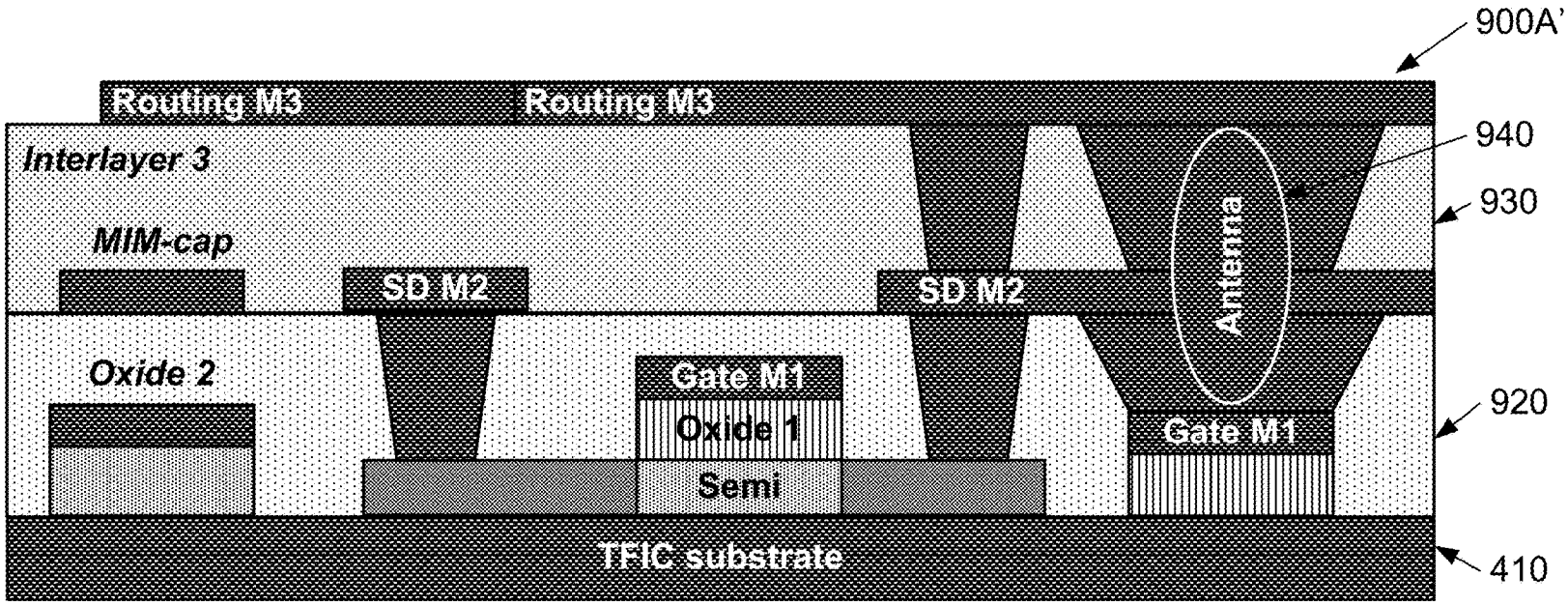
FIG. 18A is similar to FIG. 13A, but provides additional shielding for the components, according to example embodiments.

FIG. 18A illustrates a single-gate SAL TFT architecture or implementation 900A which is similar to the implementation 900 shown in FIG. 13A. Components previously described with respect to implementation 900 are referenced the same. In FIG. 18A, routing metal ("Routing M3") formed over layer 930 extend over electronic components ("Gate M1/Oxide 1" stack) in layer 920 as shown. In comparison to FIG. 13A, the electronic components are shielded by the routing metal ("Routing M3") formed over layer 930 to reduce electromagnetic interference thereat.

Figure 18B:
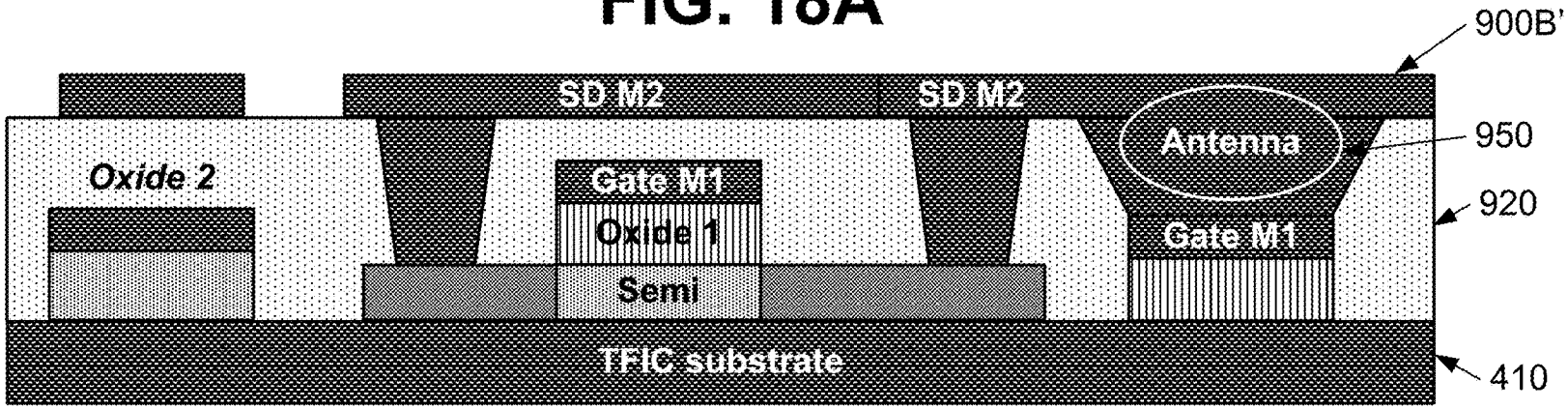
FIG. 18B is similar to FIG. 13B, but provides additional shielding for the components, according to example embodiments.

FIG. 18B illustrates a dual-gate SAL TFT architecture or implementation 900B' which is similar to implementation 900B shown in FIG. 13B. Components previously described with respect to implementation 900 are referenced the same. In FIG. 18B, SD metal ("SD M2") formed over layer 920 extend over electronic components ("Gate M1/Oxide 1" stack) in layer 920 as shown. In comparison to FIG. 13B, the electronic components are shielded by the SD metal ("SD M2") formed over layer 920 to reduce electromagnetic interference thereat.

In effect, as shown in FIGS. 6A to 6C, there are areas on the substrate where no metal or semiconductor is deposited which form resistive features having sheet resistance values greater than 100 $\Omega m^2/m$, e.g., and preferably greater than 1000 $\Omega m^2/m$ (also denoted as "Ω·sq" or "Ω/sq") for an area greater than 1 $mm^2$.

In this way, electromagnetic radiation from a reader configured for reading a tag incorporating an antenna device in accordance with the present disclosure can pass through the tag without interfering with the transistor layer component of the device. In particular, in FIG. 6A, the area is within the antenna 210 of the inductive (coil) antenna 200; in FIG. 6B, the area is between the two capacitive plates 260*a* and 260*b* of the capacitive (plate) antenna 250; and in FIG. 6C, the area is between poles 310 and 320 of the dipole antenna 300.

Additional deposition methods, such as, printing, may be used to form the conductive structures for monolithically integrated antennas in accordance with the present disclosure. Printing processes may be performed as post-process steps to the chip manufacturing. Printing may include, but not limited to: inkjet, gravure, offset, flexography and screen printing. Materials are conductive inks of metal or metal-oxide (nano-) particles in a solvent often with additional polymeric binders to adjust viscosity. The deposition process is followed by a sintering process to remove the organic binder and sinter the metal to achieve higher conductivity. The sintering process can be based on thermal anneal, microwave anneal, laser anneal or annealing with any other electromagnetic wave (e.g. visible light). The cost to realize structured metal layer is rather low compared to standard etch and lift-off techniques used for PVD metal, however, the lateral resolution is limited to several 10 μm. Whilst printing costs may be relatively low compared to PVD and electroplating, there are only a few metals that allow for easy ink formulation and sintering, such as, silver, and, to a lesser extent, copper.

Monolithic devices in accordance with the present disclosure are thinner, and, the antenna component and the chip component are manufactured on the same substrate without having to assemble the device from two separate substrates as described above with reference to FIGS. 2A and 2B. A total device thickness in a range of 10 to 100 μm is possible which may allow for, for example, a seamless integration of ID tags into paper.

In addition, monolithic devices in accordance with the present disclosure are more mechanically robust, and, adhesive may not be used to connect the chip and the antenna together on a chosen substrate. Mechanical robustness will be increased as the physical interface between the chip and the antenna will be larger, that is, greater than 10 $mm^2$ (compared to the one in traditional assembly process of around 1 $mm^2$).

The monolithic devices in accordance with the present disclosure can be implemented in thin-film RFID, NFC, CAPID tags. They may also be used for thin-film wireless sensors.

Although specific embodiments of the present disclosure have been described, these are by way of example only and other embodiments may be possible.

The invention claimed is:

1. A monolithically integrated antenna device comprising:

a substrate having a first surface and a second surface;

a transistor component layer comprising at least one electronic component therein; and at least one antenna structure formed on the substrate or the transistor component layer, wherein the antenna structure and the at least one electronic component are monolithically integrated, wherein the antenna structure is configured to operate in a frequency range of between 30 kHz and 2.4 GHz, wherein the substrate is configured to have a size that is the same or larger than the at least one antenna structure, wherein the at least one antenna structure is formed in a stack with the transistor component layer and the substrate, and wherein the monolithically integrated antenna device is configured to shield the at least one electronic component in the transistor component layer from electromagnetic interference.

2. The monolithically integrated antenna device according to claim 1, wherein the transistor component layer is formed on the first surface of the substrate, wherein the at least one antenna structure comprises a first antenna structure formed over the transistor component layer, wherein the monolithically integrated antenna device further comprises at least one interlayer stacked between the transistor component layer and the first antenna structure, and wherein the first antenna structure is configured to extend over the at least one electronic component in the transistor component layer to thereby shield the at least one electronic component from electromagnetic interference.

3. The monolithically integrated antenna device according to claim 1, further comprising a stack comprising a first interlayer, a shielding layer, and a second interlayer, wherein the first interlayer and the second interlayer are separated by the shielding layer, and wherein the shielding layer is configured to extend over the at least one electronic component in the transistor component layer to thereby shield the at least one electronic component from electromagnetic interference.

4. The monolithically integrated antenna device according to claim 1, wherein the at least one antenna structure comprises a first antenna structure formed on the first surface of the substrate, wherein the transistor component layer is formed over the first antenna structure, wherein the monolithically integrated antenna device further comprises a dielectric layer over the transistor component layer and a routing metal layer extending through the dielectric layer for connecting to the transistor component layer, and wherein the routing metal layer is configured to extend over the at least one electronic component in the transistor component layer to thereby shield the at least one electronic component from electromagnetic interference.

5. The monolithically integrated antenna device according to claim 4, further comprising at least one first interlayer stacked between the first antenna structure and the transistor component layer.

6. The monolithically integrated antenna device according to claim 1, wherein the at least one antenna structure comprises a first antenna structure formed on the first surface of the substrate, wherein the transistor component layer is formed over the first antenna structure, and wherein the monolithically integrated antenna device further comprises a metal contact layer configured to extend over the at least one electronic component in the transistor component layer to thereby shield the at least one electronic component from electromagnetic interference.

7. The monolithically integrated antenna device according to claim 6, further comprising an interlayer between the first antenna structure and the transistor component layer.

8. The monolithically integrated antenna device according to claim 6, further comprising a stack comprising a first interlayer, a shielding layer, and a second interlayer between the first antenna structure and the transistor component layer.

9. The monolithically integrated antenna device according to claim 1, wherein the transistor component layer is formed on a first side of the substrate and the at least one antenna structure is formed on a second side of the substrate.

10. The monolithically integrated antenna device according to claim 1, wherein the antenna structure is configured as a dipole antenna, a capacitive antenna, or an inductive antenna.

11. A wireless tag comprising a monolithically integrated antenna device according to claim 1.

* * * * *